United States Patent [19]

Palmer

[11] Patent Number: 4,939,315

[45] Date of Patent: Jul. 3, 1990

[54] SHIELDED AUDIO CABLE FOR HIGH FIDELITY SIGNALS

[76] Inventor: Donald E. Palmer, 1275 Vicente, #189, Sunnyvale, Calif. 94086

[21] Appl. No.: 279,391

[22] Filed: Dec. 2, 1988

[51] Int. Cl.[5] ..... H01B 11/18

[52] U.S. Cl. ..... 174/36; 174/32

[58] Field of Search ..... 174/32, 36; 307/89, 307/91

[56] References Cited

U.S. PATENT DOCUMENTS

| | | | |
|---|---|---|---|
| 1,096,175 | 5/1989 | Kitsee | 174/36 |
| 2,278,177 | 3/1942 | Lacy | 174/36 |
| 2,322,971 | 6/1943 | Roosenstein | 174/36 |
| 2,518,271 | 8/1950 | Baranov | 174/32 |
| 2,624,794 | 1/1953 | Gooding | 174/36 X |
| 4,822,956 | 4/1989 | Sepe | 174/36 X |

FOREIGN PATENT DOCUMENTS

| | | | |
|---|---|---|---|
| 288293 | 6/1987 | United Kingdom | 174/36 |

*Primary Examiner*—Morris H. Nimmo

*Attorney, Agent, or Firm*—Townsend and Townsend

[57] ABSTRACT

An interconnection cable for audio frequency high fidelity applications is provided wherein a conductive shielding is a sheath which is divided into two segments, wherein the sheath surrounds at least one signal-carrying conductive lead from which the shield is insulated, wherein the sheath has a single electrical discontinuity separating each segment of the sheath, wherein each segment of the sheath is conductively terminated at its respective end of the cable in a signal common or ground, and wherein the electrical discontinuity is at between 9/16 and 23/32 of the distance from a reference end and preferably at between ⅝ and ⅔ of the distance from the reference end. It is preferable that the reference end is at the signal source and the other end is at the signal load. High frequency distortion caused by radio frequency noise is minimized where the discontinuity is at the ⅝ distance from the reference end, and ringing in the lead due to coupling between the shield and the lead is minimized where the discontinuity is at the ⅔ distance. To minimize both ringing and r.f.-induced distortion, the discontinuity is preferably disposed between these two minima. The desired effects are not significant for a discontinuity which is disposed at less than 9/16 or greater than 23/32 of the distance from the reference end.

10 Claims, 1 Drawing Sheet

SHIELDED AUDIO CABLE FOR HIGH FIDELITY SIGNALS

BACKGROUND OF THE INVENTION

This invention relates to audio high fidelity cables or transmission lines wherein the wavelength of signals carried on the transmission lines are generally longer than the length of the transmission lines, such as in audio signal and high fidelity sound reproduction applications. The invention has particular application where the range of frequencies is greater than several octaves and therefore wherein spurious oscillations (ringing) and broadband random noise carried on the transmission line can have potentially significant impact on the fidelity of a complex signal carried by the transmission line.

In contrast to long transmission lines where the impedance of the cable is matched to the impedance of the termination loads, it is conventional in short transmission lines to reduce the impedance, and more particularly the resistance, of the cable to a minimum to reduce the electrical resistive loss in the cable. When used in high fidelity audio signal interconnection cabling, as between components in an audio component system, such an approach introduces secondary problems, such as audible enhancement of the "brightness" frequencies (1000 Hz to 2000 Hz range) and can cause distortion in the desired audio frequency signals. The primary causes of these effects appear to be radio-frequency noise and spurious oscillation (ringing) in the interconnect cables.

It is common practice in low-signal-level audio frequency circuitry to provide a shielding sheath surrounding signal conductors between subsystems and within components of an audio system. A typical configuration is a twisted pair of conductors surrounded by a nonferromagnetic foil or braided sheath which is terminated at one end of the cable. This type of shielding exploits the Faraday Effect and is adequate for minimizing interference from sources external to the shield.

Noise which is internally generated in audio equipment can couple into the terminated shield surrounding the signal cable, which can cause a spurious oscillation (ringing) of an electromagnetic nature in the shield itself. The added noise and resultant ringing on the shield can couple to the signal leads, primarily by capacitive coupling between the shield and the signal leads. This coupling is aggravated where the length of the shield and the length of the signal lead are substantially equal. Thus the natural length-wise mode of ringing in each element is nearly identical, which can result in efficient tuned coupling between the shield and the leads. This is an undesirable condition.

It appears further that radio frequency sources can induce distortion in audio signals carried over leads of a shielded cable. The sources may be either internal (in an amplifier for example) or external (in a television set). The effects of radio frequency noise on audio frequency signals appear to be most pronounced at the higher audio frequencies, where distortion has been noted. The presence of oscillations and modal resonances in cables is believed to result in undesired enhancement in the "brightness" frequencies (1000 Hz 2000 Hz range). These effects are undesirable if accurate reproduction of recorded music and the like is desired.

SUMMARY OF THE INVENTION

According to the invention, an interconnection cable for audio frequency high fidelity applications is provided wherein a conductive shielding is a sheath which is divided into two segments, wherein the sheath surrounds at least one signal-carrying conductive lead from which the shield is insulated, wherein the sheath has a single electrical discontinuity separating each segment of the sheath, wherein each segment of the sheath is conductively terminated at its respective end of the cable in a signal common or ground, and wherein the electrical discontinuity is at between 9/16 and 23/32 of the distance from a reference end and preferably at between $\frac{5}{8}$ and $\frac{2}{3}$ of the distance from the reference end. It is preferable that the reference end is at the signal source and the other end is at the signal load.

It has been discovered that high frequency distortion caused by radio frequency noise is minimized where the discontinuity is at the $\frac{5}{8}$ distance from the reference end and that ringing in the conductor due to coupling between the shield and the conductor is minimized where the discontinuity is at the $\frac{2}{3}$ distance. To minimize both ringing and r.f.-induced distortion, the discontinuity is preferably disposed between these two minima. It has further been discovered that the desired effects are not significant for a discontinuity which is disposed at less than 9/16 or greater than 23/32 of the distance from the reference end. (Thus, desired reduction in noise and ringing is apparent for a single discontinuity placed at a distance in the range 9/32 to 7/16 and 9/16 to 23/32 along the length of the cable.)

The invention will be better understood by reference to the following detailed description taken in conjunction with the accompanying drawings.

DESCRIPTION OF SPECIFIC EMBODIMENTS

Figure 1:
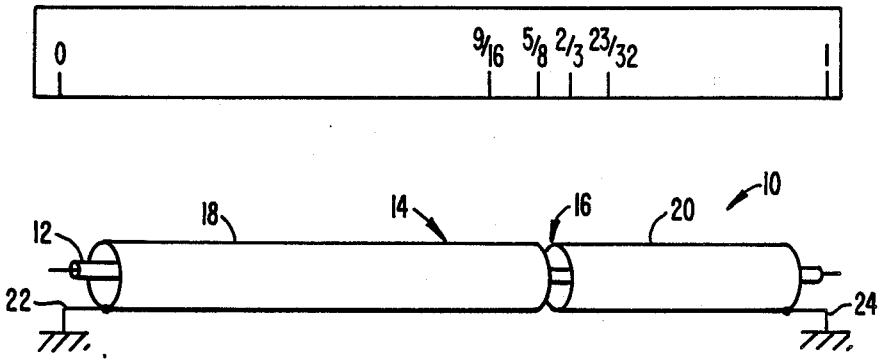
FIG. 1 is a perspective view of a coaxial cable constructed in accordance with the invention showing positioning of a discontinuity and showing a scale indicating position ranges for said discontinuity.

Referring to FIG. 1, there is shown a perspective diagram of a cable 10 according to the invention which comprises an insulated electrically-conductive lead 12 for carrying signals intended primarily for the audio range and an electrically-conductive shielding 14 disposed surrounding the lead 12. The shielding 14 is formed in a sheath, preferably a foil of nonferromagnetic material such as aluminum or aluminized polyester film. Alternatively, the shielding 14 may be a braiding of copper or the like.

According to the invention, there is provided an electrical discontinuity 16 in the shielding 14 at a preselected distance from a reference end of the cable 10 forming a first segment 18 and a second segment 20. The discontinuity 16 may be a space or like electrical separation of on the order of $\frac{1}{4}$ inch. Each segment 18 and 20 of the shielding 14 is conductively terminated at its respective end 22 and 24 of the cable 10 in a signal common or ground.

According to the invention, the electrical discontinuity 16 is at between 9/16 and 23/32 of the distance from a reference end 22. Preferably, the electrical discontinuity 16 is disposed at between $\frac{5}{8}$ and $\frac{2}{3}$ of the distance from the reference end 22. It is preferable that the reference end 22 is at the signal source and the other end 24 is at the signal load when installed as a conductor between components or subsystems in an audio system.

The placement of the discontinuity 16 is important. It has been discovered that high frequency distortion caused by radio frequency noise is minimized where the discontinuity 16 is at the ½ distance (62% of the length of the cable 10) relative to the reference end 22. It is speculated that this discontinuity distance provides maximum separation between the fundamental mode of resonance and higher modes of resonance. At this distance, none of the natural wire resonance modes are reinforced below the fifth harmonic of the conductive lead 12.

Moreover, it has been discovered that the primary mode of oscillation (ringing at the half-wave mode) in the conductive lead 12 due to coupling between the shielding 14 and the conductive lead 12 is minimized where the discontinuity 16 is at the ⅔ distance (67% of the cable length from the reference end 22). It is believed that the primary mode of ringing is minimized because the ratios of the second segment 20 to the first segment 18 to the lead 12 is 1:2:3, which yields ratios which provide that no two of the natural resonant frequencies of the three segments are closer to one than the other.

To minimize both ringing and r.f.-induced distortion, a compromise is possible. The discontinuity 16 is preferably disposed between the two minima at ⅝ and ⅔ (62% to 67%). Both noise reduction techniques are apparent within this range but are not optimized as to either.

It has further been discovered that the desired effects are not significant for a discontinuity 16 which is disposed at less than 9/16 or greater than 23/32 of the distance from the reference end 22. As the length of the longer segment 18 is increased above 72%, it approaches the length of the lead 12, which may result in resonance therebetween. As the length of either segment 18 or 20 approaches 50% of the length of the lead 12, both segments 18 and 20 approach half-wave (second harmonic) resonance with the lead 12. Thus, noise and ringing suppression is apparent for a single discontinuity placed in the distance range 9/32 to 7/16 and 9/16 to 23/32 along the length of the cable.

Figure 2:
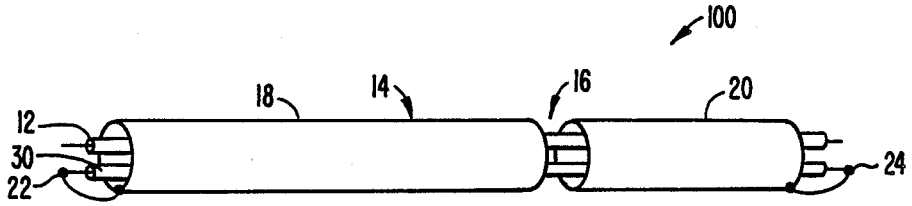
FIG. 2 is a perspective view of a shielded twisted pair cable constructed in accordance with the invention.

Referring to FIG. 2, there is shown a perspective view of a dual conductor shielded cable 100 constructed in accordance with a second embodiment of the invention. The numbering in FIG. 2 corresponds to the numbering of FIG. 1. In the embodiment of FIG. 2, the cable 100 is provided with a second lead 30. The second lead 30 may be twisted around the first lead 12 to form a twisted pair. The second lead 30 may serve as a signal return for a signal carried on the first lead 12. In addition, in accordance with the invention, the first segment 18 may be coupled at its terminating end 22 to the second lead 30, and the second segment 20 may also be connected at its terminating end 24 to the second lead 30. If the second lead 30 is coupled to a signal ground, then the cable 10 would contain an unbalance twisted pair, and the cable 12 would form a shielded unbalanced twisted pair cable. The placement of the discontinuity 16 in the shielding 14 is selected as in the placement of the discontinuity 16 for the embodiment of FIG. 1.

The invention has now been explained with reference to specific embodiments. Other embodiments will be apparent to those of ordinary skill in this art in light of this disclosure. Therefore, it is not intended that this invention be limited except as indicated by the appended claims.

I claim:

1. An interconnection cable for audio frequency high fidelity applications comprising:

at least one signal-carrying insulated conductive lead; and a conductive shielding forming a sheath surrounding said conductive lead, wherein said sheath is divided into two segments, wherein the sheath has a single electrical discontinuity separating each segment of the sheath, wherein each segment of the sheath is conductively terminated at its respective end of the cable in a signal common or ground, and wherein the electrical discontinuity is at between 9/16 and 23/32 of the distance from a reference end of said cable.

2. The apparatus according to claim 1 wherein said discontinuity is at between ⅝ and ⅔ of the distance from the reference end.

3. The apparatus according to claim 2 wherein the reference end is at the signal source and the other end is at the signal load.

4. The apparatus according to claim 1 wherein the reference end is at the signal source and the other end is at the signal load.

5. The apparatus according to claim 1 further including a second insulated conductive lead, wherein said second conductive lead is a signal return lead.

6. The apparatus according to claim 5 wherein said second lead is electrically coupled at each end to a segment of said sheath.

7. The apparatus according to claim 5 wherein each of the segments of said sheath is electrically coupled at each end of the cable to a ground.

8. The apparatus according to claim 1 wherein said sheath is nonferromagnetic.

9. The apparatus according to claim 8 wherein said sheath is a foil.

10. The apparatus according to claim 1 wherein said sheath is a foil.

* * * * *